US006679499B2

(12) United States Patent
Jeon

(10) Patent No.: US 6,679,499 B2
(45) Date of Patent: Jan. 20, 2004

(54) METHOD FOR STANDING A STICK BETWEEN MEDALS IN A PREMIUM ARCADE GAME

(75) Inventor: Ju Young Jeon, Yongsan-Gu (KR)

(73) Assignee: Ma Eolith Co., Ltd., Seoul (KR)

( * ) Notice: Subject to any disclaimer, the term of this patent is extended or adjusted under 35 U.S.C. 154(b) by 136 days.

(21) Appl. No.: 10/115,640

(22) Filed: Apr. 3, 2002

(65) Prior Publication Data

US 2003/0116919 A1 Jun. 26, 2003

(30) Foreign Application Priority Data

Sep. 10, 2001 (KR) ..... 2001-55405

(51) Int. Cl.[7] ..... A63B 67/00
(52) U.S. Cl. ..... 273/448
(58) Field of Search ..... 273/138.3, 148 R, 273/154, 274, 281, 287, 384, 440, 441, 447–449

(56) References Cited

U.S. PATENT DOCUMENTS

| | | | | | |
|---|---|---|---|---|---|
| 1,708,734 | A | * | 4/1929 | Olander | 273/440 |
| 3,208,747 | A | * | 9/1965 | Kavakos | 273/441 |
| 4,305,582 | A | * | 12/1981 | Barton | 446/486 |
| 5,082,274 | A | * | 1/1992 | Bright | 273/138.2 |
| 5,954,340 | A | * | 9/1999 | Tedesco | 273/450 |
| 6,283,475 | B1 | * | 9/2001 | Stubben | 273/448 |

* cited by examiner

*Primary Examiner*—John M. Hotaling, II
(74) *Attorney, Agent, or Firm*—Harness, Dickey & Pierce, P.L.C.

(57) ABSTRACT

The present invention relates to a method for standing a fallen stick between medals in a premium arcade game. In particular, it relates to a method for electronically detecting the stick being knocked down during a game and automatically re-standing the fallen stick by simple mechanical procedures in a premium arcade game that a user rakes down as many medals heaped up on a plate as possible without knocking down a stick standing between the medals by controlling a joy-stick or up/down buttons.

4 Claims, 8 Drawing Sheets

METHOD FOR STANDING A STICK BETWEEN MEDALS IN A PREMIUM ARCADE GAME

BACKGROUND OF THE INVENTION

1. Field of the Invention

The present invention relates to a method for standing a fallen stick between medals in a premium arcade game. In particular, it relates to a method for re-standing a fallen stick, which is knocked down during the game, by simple procedures using an electro-mechanical technique in a premium arcade game that a user rakes down as many medals heaped up on a plate as possible without knocking down a stick standing between the medals by controlling a joy-stick or up/down buttons.

2. Description of the Related Art

In general, there are various types of arcade games such as a shooting game, a Go game, and sports games, and a user can play a game after paying a prescribed fee.

Among these arcade game machines, some machines are designed to awards various gifts to users who score more than a certain preset level for attracting users, and thereby increasing the frequency of playing games.

In other words, a gift supplier is equipped in a game machine in which various gifts are allocated to corresponding levels of score or winning percentage, and when a player gets to the preset score or winning percentage during a game, it awards a corresponding gift.

For example, levels of score can be specified to be 100,000 points, 300,000 points, 500,000 points, and so on. Different gifts are allocated to different corresponding levels. And, when a player gets to a certain level of preset points described above during a game, the game machine awards a corresponding gift to the player.

Here, by installing light emitting diodes around a game machine and operating them to be ON and OFF repeatedly while a gift is being awarded, the visual effect can be maximized.

Since a user has a chance to obtain a gift by simply playing a game, he(or she) becomes to be more interested at this kind of premium game than ordinary games. And thus, the frequency of playing a game machine having a gift supplier is notably increased so that the total income of a gameroom can be increased.

In these days, dance/music simulation games, such as a DDR(Dance-Dance-Revolution), have led the main stream of domestic arcade game market in Korea. However, as the dance/music simulation games recently lose their popularity rapidly, the arcade game business community including game developers, distributors, and gameroom owners becomes to be severely stagnant due to the absence of "post-DDR".

Various types of premium game machines have been proposed for substituting the dance/music simulation games, however, they cannot jump over their limit and stay in their typical stereotype game style such as a crane-game or a punching-game.

And now, gamers want to play a game having a novel feature instead of stereotype games similar to one another. In other words, a new game, which is totally different from the previous stereotype games, is required.

In addition, a new type of premium arcade game that is able to maximize the advantage of premium game is required so that everybody can easily play and enjoy the game.

To meet the gamer's demand described above, the inventors of the present invention have presented a premium arcade game that a user rakes down as many medals as possible without knocking down a stick standing between the medals.

In other words, we have presented a novel type gaming method by which a user controls a crane installed in a game machine to rake down the medals on a plate without knocking down a stick standing between medals, and obtains a gift when he rakes down more medals than a certain preset number.

During the game described above being played, however, once the stick standing between medals is knocked down, the game is over and the fallen stick has to be re-stood by using a mechanical technique.

Since this re-standing procedure has to be repeated whenever the stick is knocked down, it has a limitation that it is ineffective to re-stand the stick by using a mechanical technique only.

SUMMARY OF THE INVENTION

The present invention is proposed to solve the problems of the prior art mentioned above. It is therefore the object of the present invention to provide a method for electronically detecting the stick being knocked down during a game and automatically re-standing the fallen stick by simple mechanical procedures in a premium arcade game that a user rakes down medals heaped up on a plate without knocking down a stick standing between the medals.

To achieve the object mentioned above, the present invention presents a method for standing a fallen stick between medals in a premium arcade game, characterized by using a stick standing apparatus comprising:

- a light emitting sensor and a light receiving sensor, installed at left/right inside wall of a game machine respectively, for detecting whether or not the stick is knocked down;
- a microswitch for detecting the stick being knocked down by a wire, connected to the end of the stick, being pulled;
- a control section for controlling a stick actuation motor according to the signals from the light emitting/receiving sensors and the microswitch; and
- a stick actuation motor for actuating the wire connected to the end of the stick to be pulled or loosed according to the control signal from the control section, and characterized by comprising the steps of:

- detecting whether or not the stick is knocked down on a plate by using the light emitting/receiving sensors and the microswitch;
- actuating the stick actuation motor to rotate forward according to the control signal from the control section in case that the stick knock-down is detected;
- judging that the operation state of the microswitch is ON or OFF;
- if the microswitch is in OFF-state, actuating the stick actuation motor to rotate forward, according to the control signal from the control section, to pull the wire until the stick is stood up completely; and
- if the microswitch is in ON-state, actuating the stick actuation motor to rotate backward, according to the control signal from the control section, to loose the pulled wire so that the stick can be knocked down by an external impact.

DETAILED DESCRIPTION OF THE EMBODIMENTS

Hereinafter, referring to appended drawings, the structures and the operation procedures of an embodiment of the present invention are described in detail.

Figure 1:
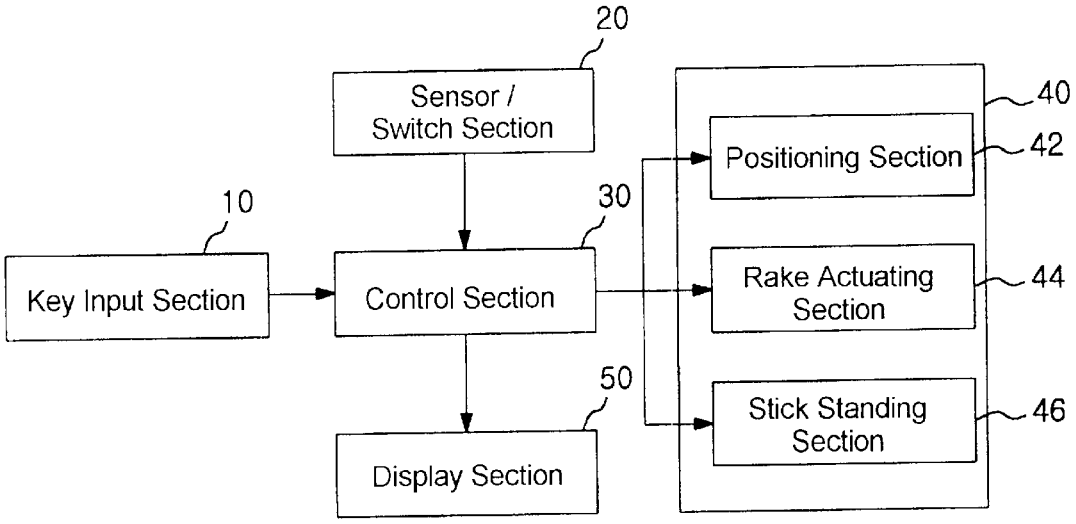
FIG. 1 is a block diagram illustrating a premium arcade game machine in accordance with the present invention.
Figure 2:
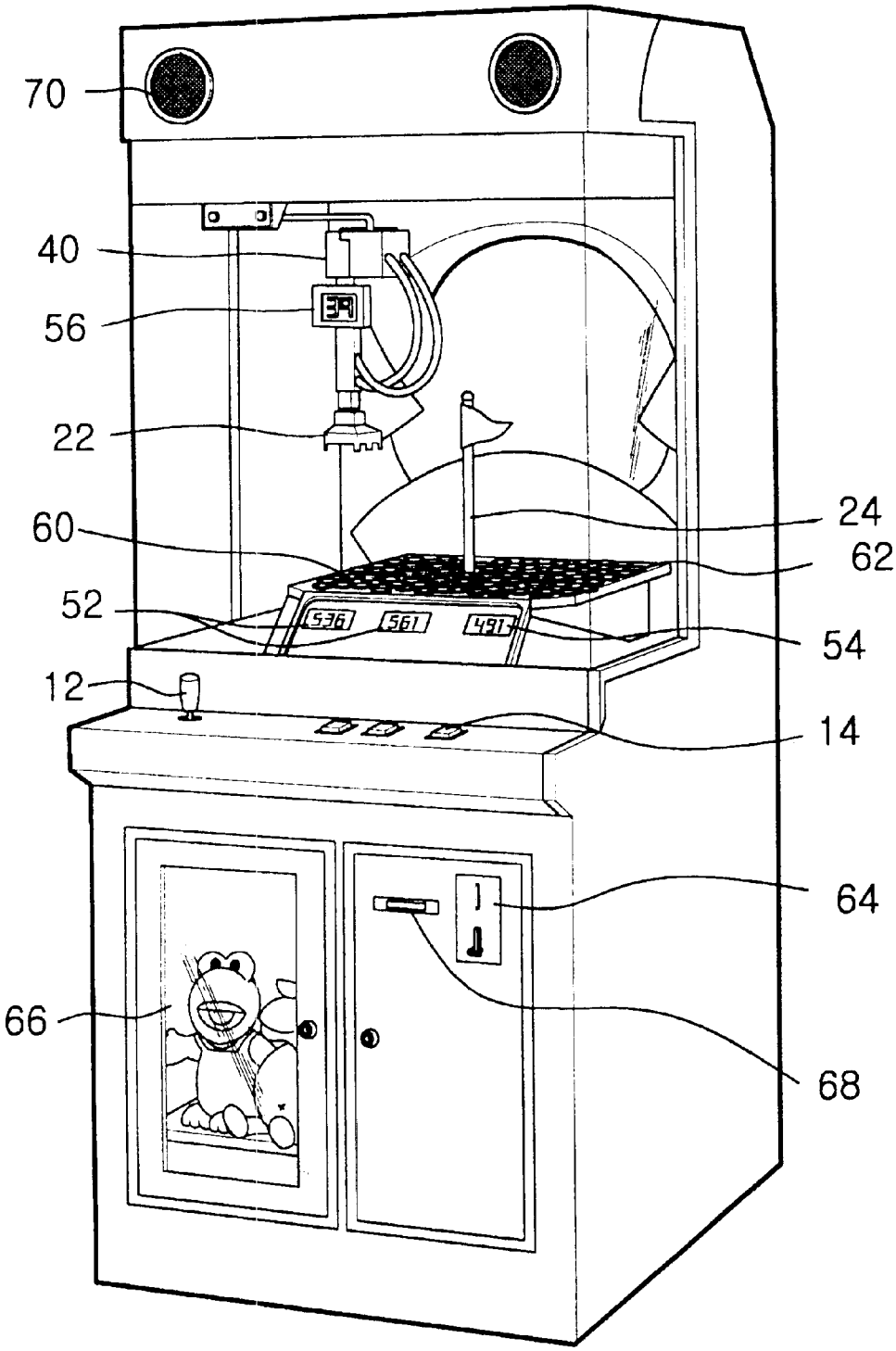
FIG. 2 is a perspective view illustrating a premium arcade game machine in accordance with the present invention.

FIG. 1 is a block diagram illustrating a premium arcade game machine for raking down medals without knocking down a stick standing between medals in accordance with the present invention. FIG. 2 is a perspective view illustrating a premium arcade game machine for raking down medals without knocking down a stick standing between medals in accordance with the present invention.

Referring to FIG. 1, an arcade game machine in accordance with the present invention comprises: a key input section(10) equipped with various key input buttons for playing a game; a sensor/switch section(20) for sensing the movement of a rake(22) and the positioning state of a stick(24); a control section(30) for controlling the movement of the rake(22) and the actuation of the stick(24) according to the output signal from the key input section(10) and the sensor/switch section(20); a motor actuating section(40) for actuating the rake(22) and the stick(24) according to the control signal from the control section(30); and a display section(50) for displaying the progressive state of current game according to the control signal from the control section(30).

The motor actuating section(40) preferably comprises: a positioning section(42) for positioning the rake(22) and the stick(24) according to the control signal from the control section(30); a rake actuating section(44) for actuating the rake(22) according to the control signal from the control section(30); and a stick standing section(46) for standing the stick(24), when it is knocked down, according to the control signal from the control section(30).

In detail, referring to FIG. 2, the key input section(10) comprises a joystick and numbers of buttons such as an UP button, a DOWN button, and a START button for playing the game.

The display section(50) is composed of light emitting diodes(LED) and comprises a window(52) for displaying the number of required medals for obtaining a gift; a window (54) for displaying the current number of medals raked down; and a window(56) for displaying the remaining game time.

In addition to the components described above, a premium arcade game machine in accordance with the present invention further comprises: medals(60) heaped up on a plate(62); a coin inserting slot(64) for inserting a coin; a gift showcase(66) in which various gifts are exhibited; a card issuing slot(68) for issuing a gift exchange card; and a speaker(70) for generating various sounds and information announcements according to the game situation.

Next, the operation procedures of the game machine described above are described in detail.

First, the values of joystick movement and/or ON/OFF values of various buttons according to user's operation on the key input section(10) are transferred to the control section(30).

The control section(30) transmits a control signal for actuating the rake(22) to the rake actuating section(44) of the motor actuating section(40).

And then, the rake(22) are actuated to move front/back/left/right by the rake actuating section(44) according to the control signal from the control section(30).

In case that the stick(24) is knocked down, the control section(30) transmits a control signal for standing the stick (24) to the stick standing section(46) of the motor actuating section(40).

Here, the sensor/switch section(20) informs the position of the rake(22) and/or the standing/knocking state of the stick(24) to the control section(30).

According to the game situation, the control section(30) transmits appropriate control signals to display section(50) for displaying the number of medals raked down, the remaining game time, and the like on the LED display.

Figure 3:
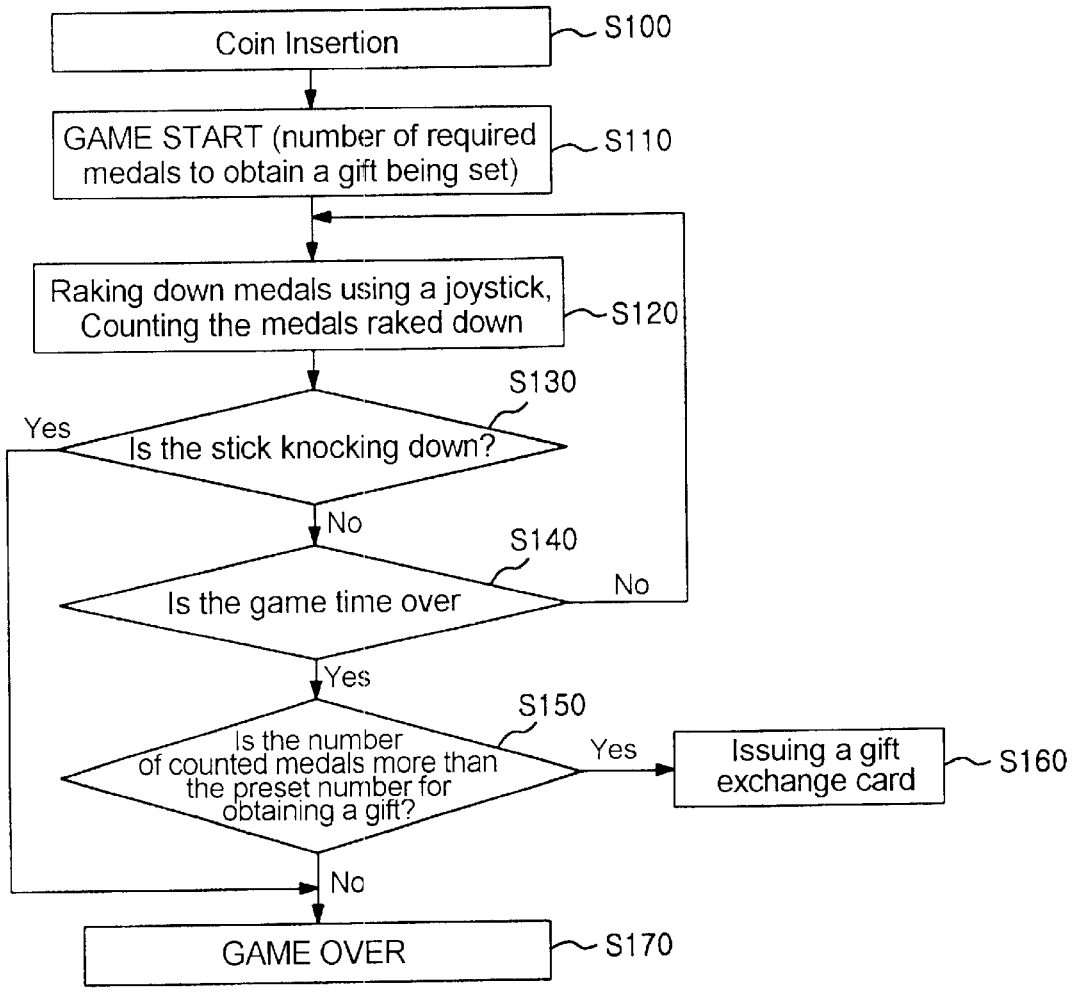
FIG. 3 is a flow chart illustrating overall gaming procedures for raking down medals without knocking down a stick standing between medals in accordance with the present invention.

FIG. 3 is a flow chart illustrating overall gaming procedures for raking down medals without knocking down a stick standing between medals in accordance with the present invention.

First, after inserting(Step S100) a coin through the coin inserting slot(64) of the game machine, a user pushes START button. When START button is pushed, a certain number is displayed on the window(52) for displaying the number of required medals to obtain a gift.

Here, the number of required medals to obtain a gift is randomly set and displayed(Step S110) by the time when START button is pushed.

And then, a user rakes down the medals(60) heaped up on a plate(62) by using a joystick for front/back/left/right movement and UP/DOWN buttons for up/down movement.

Here, a stick(24) is stood up on the plate(62) between the medals(6C), and when a user rakes down the medals(60) using a rake(22), the number of medals raked down from the plate(62) is counted(Step S120).

During the game being played, the control section(30) checks whether or not the stick(24) is knocked down by the rake(22) or by the medals(60)(Step S130).

If the stick(24) is knocked down, the game is terminated regardless of remaining game time(Step S170).

Otherwise, when the preset game time is over(Step S140), the machine counts the number of medals(60) raked down from the plate(62)(Step S150).

Here, if the counted number is more than the preset number required to obtain a gift, a user wins the game and a corresponding gift exchange card is issued through the card issuing slot(68)(Step S160).

Or, if the counted number is short for the preset number required to obtain a gift, a user loses the game and the game is terminated(Step S170).

Figure 4:
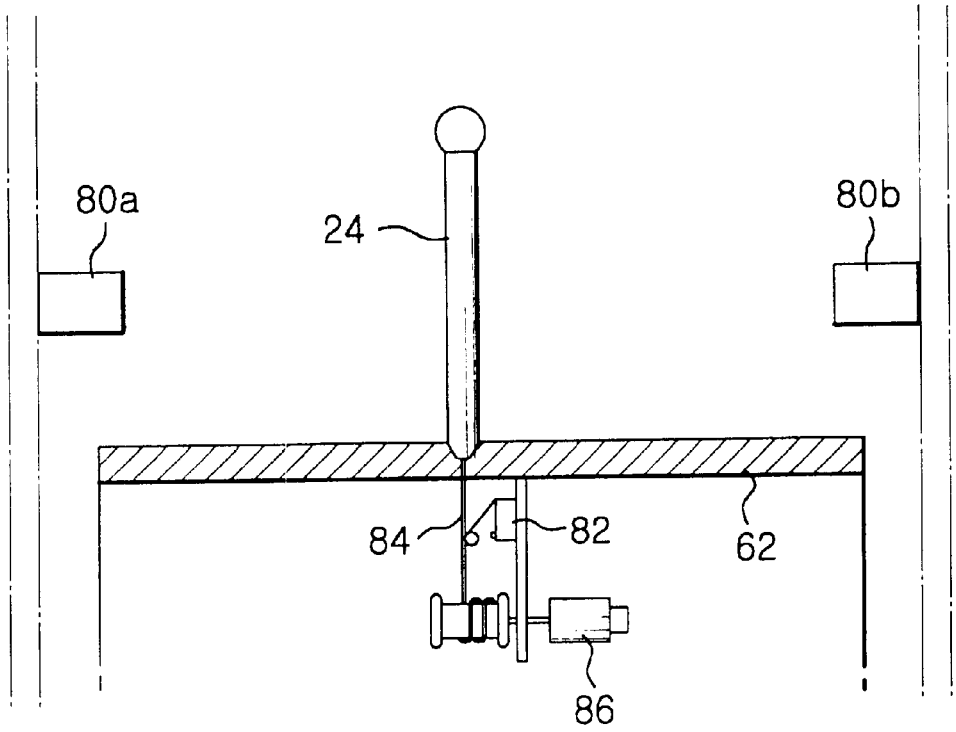
FIG. 4 is a view illustrating a detail structure of a stick standing section in accordance with the present invention.

FIG. 4 is a view illustrating a detail structure of a stick, standing section in accordance with the present invention.

Referring to FIG. 4, a stick standing section in accordance with the present invention comprises: a light emitting sensor (80*a*) and a light receiving sensor(80*b*), installed at left/right inside wall of a game machine respectively, for detecting whether or not the stick(24) is knocked down; a microswitch (82) for detecting the stick(24) being knocked down by a wire(84), connected to the end of the stick(24), being pulled; a control section(30) for controlling a stick actuation motor (86) according to the signals from the light emitting/receiving sensors(80*a*, 80*b*) and the microswitch(82); and a stick actuation motor(86) for actuating the wire(84) connected to the end of the stick(24) to be pulled or loosed according to the control signal from the control section(30).

The light emitting sensor(80*a*) and the light receiving sensor(80*b*) are installed at the left/right inside wall of a game machine respectively, and preferably installed at the center of the left/right inside wall, between which the stick(24) is located to be stood up, for detecting the stick(24) being knocked down.

The light emitting sensor(80*a*) and the light receiving sensor(80*b*) are installed at the center of the left/right inside wall and the stick(24) is located at the center of the plate(62) in accordance with an embodiment of the present invention, however, it is obvious that the locations of a light emitting sensor(80*a*), a light receiving sensor(80*b*), and a stick(24) are not limited to these positions and can be varied according to various design changes of a game machine.

Here, when the stick(24) is being knocked down, the wire(86) connected to the end of the stick(24) is being pulled to turn the microswitch(82) to be ON-state, and thus the stick knock-down is primarily sensed.

The light emitting sensor(80*a*) and the light receiving sensor(80*b*) are infrared sensors and secondarily check the stick knock-down. In case that the stick(24) is stood up, the infrared light emitted from the light emitting sensor(80*a*) is blocked by the stick(24) and cannot be received by the light receiving sensor(80*b*), and thus the sensing signal is to be OFF-state.

On the other hand, in case that the stick(24) is knocked down, the infrared light emitted from the light emitting sensor(80*a*) is received by the light receiving sensor(80*b*), and the sensing signal is to be ON-state.

FIG. 5*a*~FIG. 5*f* are views illustrating operation states of the procedures of detecting the stick being knocked down and standing the fallen stick in accordance with the present invention.

Figure 5A:
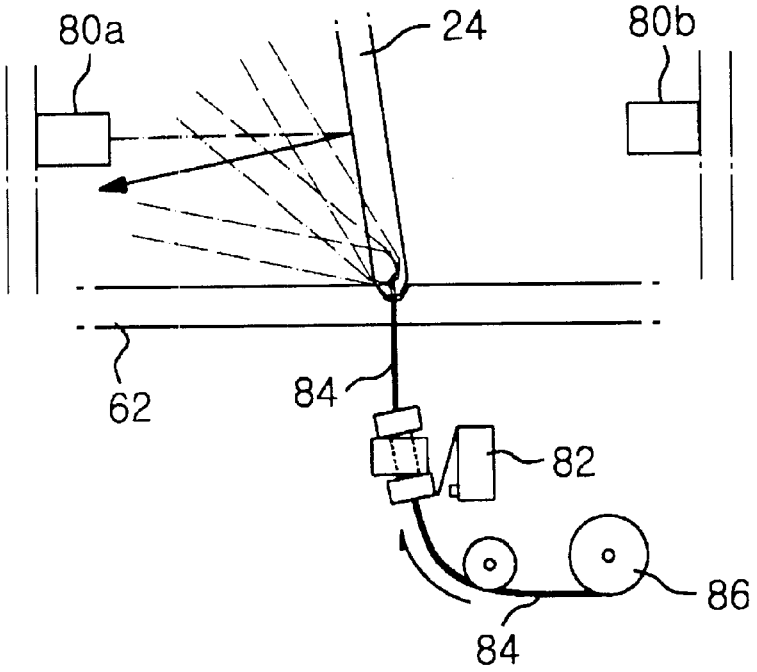
FIG. 5*a*~FIG. 5*f* are views illustrating operation states of the procedures of detecting a stick being knocked down and standing the fallen stick in accordance with the present invention.

First, looking into FIG. 5*a*, which illustrates an operation state of detecting the stick being knocked down, if the stick(24) is being knocked down on the plate(62) under the condition that the stick actuation motor(86) is in abeyance, the wire(86) connected to the end of the stick(24) is being pulled to turn the microswitch(82) to be ON-state, and thus the stick knock-down is primarily detected.

And thereafter, as the inclination of the stick gets larger, the stick knock-down is secondarily detected by the light emitting/receiving sensors(80*a*, 80*b*).

Next, referring to FIG. 5*b*~FIG. 5*f*, the procedures of re-standing the stick knocked down on the plate(62) are described in more detail.

Figure 5B:
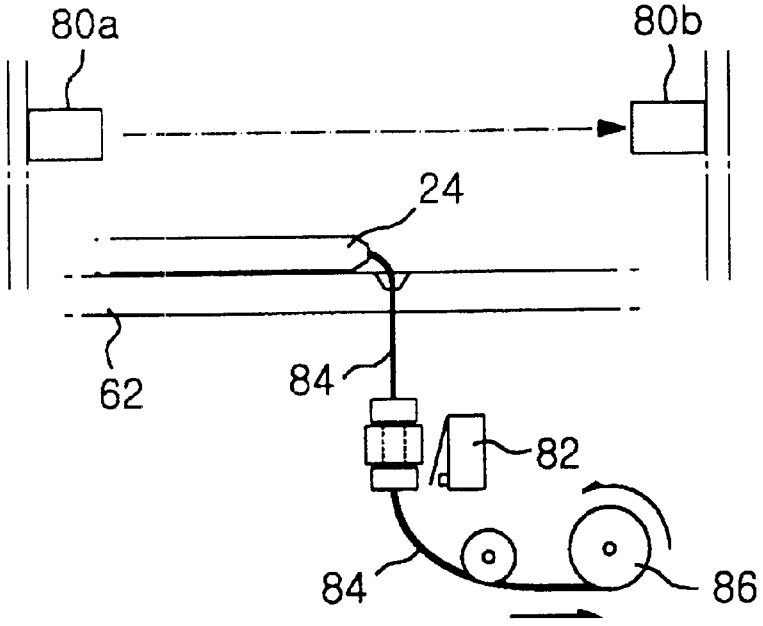

Looking into the operation state described in FIG. 5*b*, it is the state that the stick(24) is knocked down on the plate(62). In this state, the infrared light emitted from the light emitting sensor(80*a*) is received by the light receiving sensor(80*b*), and thus the sensing signal is ON-state. Here, the microswitch(82) is OFF-state and the stick actuation motor(86) is actuated to rotate forward according to the control signal from the control section(30).

Figure 5C:
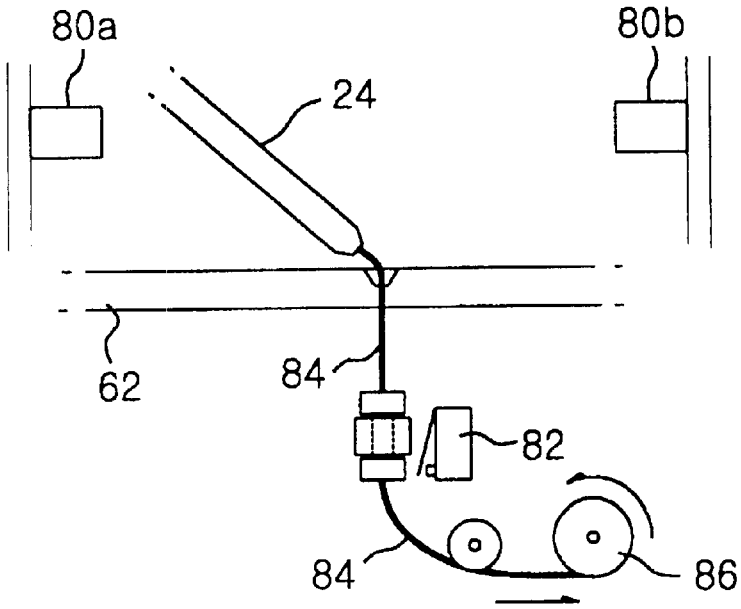

Looking into the operation state described in FIG. 5*c*, it is the state that the stick(24) is being stood on the plate(62). In this state, the sensing signal of the light emitting/receiving sensors(80*a*, 80*b*) is neither ON- or OFF-state but neutral. Here, the microswitch(82) is OFF-state and the stick actuation motor(86) is actuated to rotate forward according to the control signal from the control section(30).

Figure 5D:
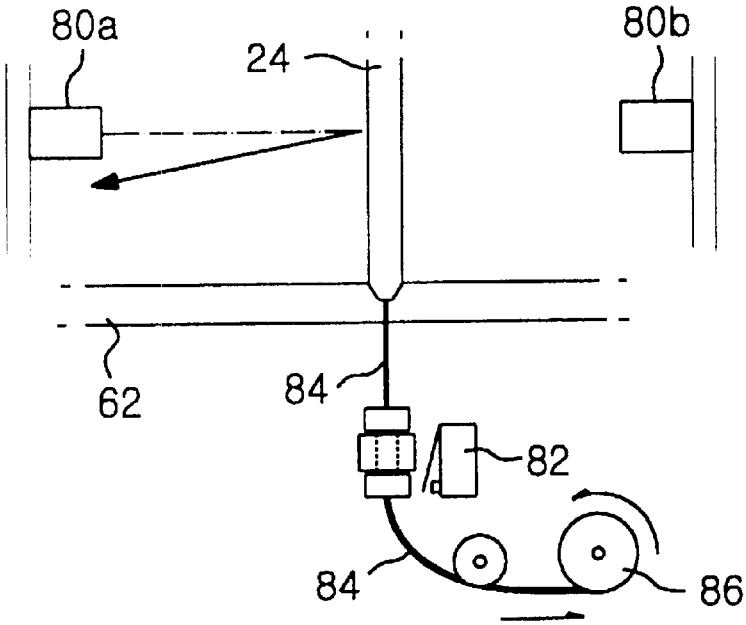

Looking into the operation state described in FIG. 5*d*, it is the state that the stick(24) is yet unstably stood on the plate(62). In this state, the infrared light emitted from the light emitting sensor(80*a*) is blocked by the stick(24) and cannot be received by the light receiving sensor(80*b*), and thus the sensing signal is OFF-state. Here, the microswitch (82) is still OFF-state and the stick actuation motor(86) is actuated to rotate forward according to the control signal from the control section(30).

Figure 5E:
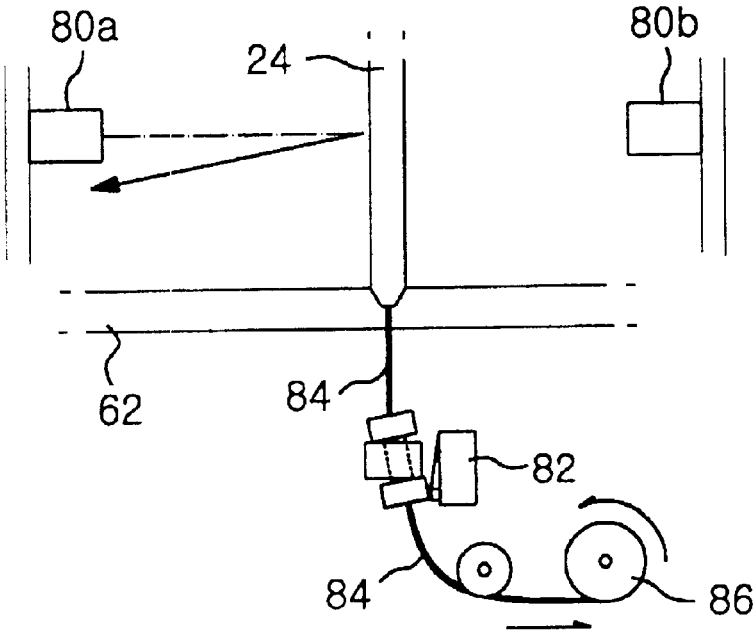

Looking into the operation state described in FIG. 5*e*, it is the state that the stick(24) is completely stood up on the plate(62). In this state, the infrared light emitted from the light emitting sensor(80*a*) is blocked by the stick(24) and cannot be received by the light receiving sensor(80*b*), and thus the sensing signal is OFF-state. Here, the microswitch (82) is ON-state and the stick actuation motor(86) is actuated to rotate forward to pull the wire(84) until the stick is completely stood up according to the control signal from the control section(30).

Figure 5F:
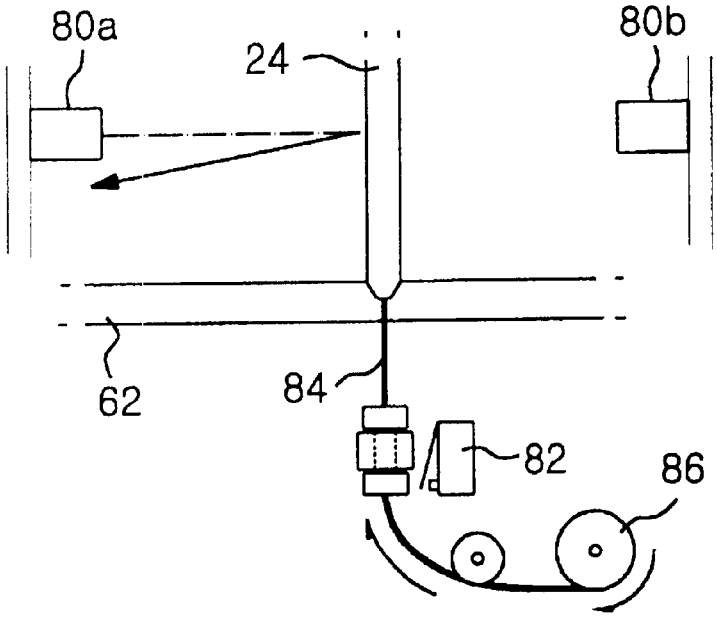

Looking into the operation state described in FIG. 5*f*, it is the state that, after the stick(24) is completely stood up on the plate(62), the wire(84) is to be loosed a little. In this state, the infrared light emitted from the light emitting sensor(80*a*) is blocked by the stick(24) and cannot be received by the light receiving sensor(80*b*), and thus the sensing signal is OFF-state. Here, the microswitch(82) is OFF-state and, on the contrary to the state described in FIG. 5*e*, the stick actuation motor(86) is actuated to rotate backward to loose the wire(84) a little so that the stick(24) can be knocked down by an external impact.

Figure 6:
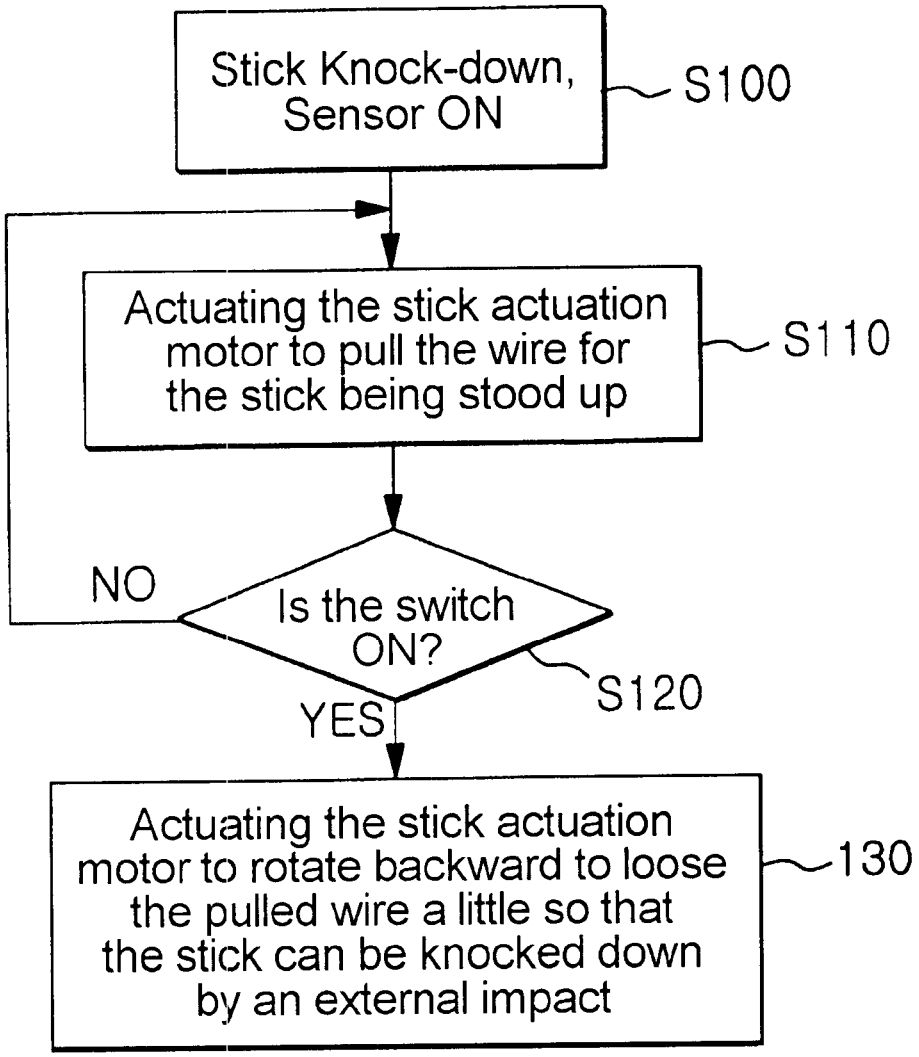
FIG. 6 is a flow chart illustrating the procedures of standing the fallen stick between medals in accordance with the present invention.

FIG. 6 is a flow chart illustrating the overall procedures of standing the fallen stick between medals in accordance with the present invention.

First, a user starts to play a game by raking down the medals(60) heaped up on a plate(62) by controlling a joystick(12) for front/back/left/right movement and UP/DOWN buttons(14) for up/down movement of the rake (22) installed in the game machine.

At this state, the light emitting sensor(80*a*) and the light receiving sensor(80*b*), installed at left/right inside wall of the game machine respectively, and the microswitch(82) are checking whether or not the stick(24) is knocked down on the plate(62).

In other words, once the stick(24) is knocked down by the rake(22), it is primarily detected by the microswitch(82), and secondarily the infrared light emitted from the light emitting sensor(80*a*) is received by the light receiving sensor(80*b*) so that the sensing signal becomes to be ON-state(Step S100).

Here, the microswitch(82) is OFF-state and the stick actuation motor(86) is actuated to rotate forward, according to the control signal from the control section(30), to pull the wire(84) until the stick is completely stood up(Step S110).

And then, the ON/OFF state of the microswitch(82) is being checked. If the stick(24) is completely stood up, the microswitch(82) is turned to be ON-state.

Note that the microswitch(82) is turned to be ON-state by the wire(84), connected to the end of the stick(24), being pulled when the stick(24) is being knocked down, however, it also performs an ON/OFF operation by checking whether or not the stick(24) is completely stood up according to the control signal from the control section(30)(Step S120).

By checking the ON/OFF state of the microswitch(82), if the microswitch(82) is still OFF-state and yet not to be ON-state, actuating the stick actuation motor(86) to rotate forward, according to the control signal from the control section(30), to pull the wire(84) until the stick(24) is completely stood up just like in Step S110.

By checking the ON/OFF state of the microswitch(82), if the microswitch(82) is ON-state, on the contrary to the state described above, actuating the stick actuation motor(86) to rotate backward, according to the control signal from the control section(30), to loose the wire(84) a little so that the stick(24) can be knocked down by an external impact(Step S130).

By following the procedures described above, the stick (24) knocked down on the plate(62) by the rake(22) controlled by a user can be re-stood up on the plate(62) repeatedly whenever it is knocked down.

As mentioned thereinbefore, a method for standing a fallen stick between medals in a premium arcade game in accordance with the present invention has the following advantages:

First, it can electronically detect the stick being knocked down during a game and automatically re-stand the fallen stick by simple mechanical procedures in a premium arcade game that a user rakes down as many medals heaped up on a plate as possible without knocking down a stick standing between the medals.

Second, it provides a gaming strategy that the game is over if the stick is knocked down during the game in a premium arcade game that a user rakes down as many medals heaped up on a plate as possible without knocking down a stick standing between the medals, and thus it can creates much attraction from users.

Since those having ordinary knowledge and skill in the art of the present invention will recognize additional modifications and applications within the scope thereof, the present invention is not limited to the embodiments and drawings described above.

What is claimed is:

1. A method for standing a fallen stick between medals in a premium arcade game, characterize by using a stick standing apparatus comprising:

a light emitting sensor and a light receiving sensor, installed at left/right inside wall of a game machine respectively, for detecting whether or not said stick is knocked down;

a microswitch for detecting said stick being knocked down by a wire, connected to the end of said stick, being pulled;

a control section for controlling a stick actuation motor according to the signals from said light emitting/receiving sensors and said microswitch; and a stick actuation motor for actuating said wire connected to the end of said stick to be pulled or loosed according to the control signal from said control section, and characterized by comprising the steps of:

detecting whether or not said stick is knocked down on a plate by using said light emitting/receiving sensors and said microswitch;

actuating said stick actuation motor to rotate forward according to the control signal from said control section in case that a stick knock-down is detected;

judging that the operation state of said microswitch is ON or OFF;

if said microswitch is in OFF-state, actuating said stick actuation motor to rotate forward, according to the control signal from said control section, to pull said wire until said stick is stood up completely; and if said microswitch is in ON-state, actuating said stick actuation motor to rotate backward, according to the control signal from said control section, to loose said pulled wire so that said stick can be knocked down by an external impact.

2. A method for standing a fallen stick between medals in a premium arcade game as claimed in claim 1, characterized in that, during the state that said fallen stick is being stood on said plate, the sensing signal of said light emitting/receiving sensors is neither ON- or OFF-state but neutral.

3. A method for standing a fallen stick between medals in a premium arcade game as claimed in claim 1, wherein said light emitting sensor and said light receiving sensor are infrared sensors.

4. A method for standing a fallen stick between medals in a premium arcade game as claimed in claim 1, or 3, characterized in that said light emitting sensor and said light receiving sensor are installed at the center of the left/right inside wall of a game machine respectively, between which said stick is located to be stood up, for detecting said stick being knocked down.

* * * * *